US010623883B2

(12) United States Patent
Bharitkar

(10) Patent No.: US 10,623,883 B2
(45) Date of Patent: Apr. 14, 2020

(54) MATRIX DECOMPOSITION OF AUDIO SIGNAL PROCESSING FILTERS FOR SPATIAL RENDERING

(71) Applicant: Hewlett-Packard Development Company, L.P., Spring, TX (US)

(72) Inventor: Sunil Bharitkar, Palo Alto, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/471,124

(22) PCT Filed: Apr. 26, 2017

(86) PCT No.: PCT/US2017/029639
§ 371 (c)(1),
(2) Date: Jun. 19, 2019

(87) PCT Pub. No.: WO2018/199942
PCT Pub. Date: Nov. 1, 2018

(65) Prior Publication Data

US 2020/0045493 A1 Feb. 6, 2020

(51) Int. Cl.

| | |
|---|---|
| ***H04R 3/00*** | (2006.01) |
| ***H04S 1/00*** | (2006.01) |
| ***H04S 5/00*** | (2006.01) |
| ***H04S 7/00*** | (2006.01) |
| ***H04R 3/14*** | (2006.01) |
| ***H04S 3/02*** | (2006.01) |
| ***G10L 19/008*** | (2013.01) |

(52) U.S. Cl.
CPC ..... *H04S 7/305* (2013.01); *G10L 19/008* (2013.01); *H04R 3/14* (2013.01); *H04S 3/02* (2013.01);

(Continued)

(58) Field of Classification Search
CPC .... H04R 3/00; H04R 3/12; H04R 3/14; H04S 1/00; H04S 1/002; H04S 3/00; H04S 3/02;

(Continued)

(56) References Cited

U.S. PATENT DOCUMENTS 6,442,277 B1 * 8/2002 Lueck ..... H04S 5/00 381/1
8,295,498 B2 10/2012 Karlsson et al.

(Continued)

FOREIGN PATENT DOCUMENTS

WO WO-2016131471 A1 8/2016

OTHER PUBLICATIONS

Nawfal, I et al., Binaural Reproduction Over Loudspeakers Using a Modified Target Response, Jun. 22-25, 2014.

*Primary Examiner* — Thang V Tran
(74) *Attorney, Agent, or Firm* — Mannava & Kang

(57) ABSTRACT

In some examples, matrix decomposition of audio signal processing filters for spatial rendering may include determining first and second spatial synthesis filters respectively as a sum and a difference of ipsilateral and contralateral spatial synthesis filters, and determining first and second crosstalk cancellation filters respectively as a sum and a difference of ipsilateral and contralateral crosstalk cancellation filters. A combined spatial synthesizer and crosstalk canceller that includes a first combined filter and a second combined filter may be determined based on application of matrix decomposition to the first and second spatial synthesis filters and the first and second crosstalk cancellation filters. Further, spatial synthesis and crosstalk cancellation on first and second input audio signals may be performed based on application of the combined spatial synthesizer and crosstalk canceller.

15 Claims, 17 Drawing Sheets

(52) U.S. Cl.
CPC ..... *H04S 2400/01* (2013.01); *H04S 2420/01* (2013.01)

(58) Field of Classification Search
CPC ..... H04S 5/00; H04S 7/305; H04S 2420/01; H04S 2400/01; H10L 19/008
See application file for complete search history.

(56) References Cited

U.S. PATENT DOCUMENTS 8,619,998 B2 12/2013 Walsh et al.
2006/0083394 A1* 4/2006 McGrath ..... H04S 3/00 381/309
2007/0223750 A1* 9/2007 Bai ..... H04S 1/002 381/309
2008/0031462 A1* 2/2008 Walsh ..... H04S 3/02 381/17
2008/0273721 A1* 11/2008 Walsh ..... H04S 5/00 381/300
2014/0226824 A1* 8/2014 Walsh ..... H04S 5/00 381/17
2014/0270185 A1* 9/2014 Walsh ..... H04S 5/00 381/17
2015/0125010 A1* 5/2015 Yang ..... H04R 3/14 381/300
2016/0227338 A1 8/2016 Oh et al.

* cited by examiner

MATRIX DECOMPOSITION OF AUDIO SIGNAL PROCESSING FILTERS FOR SPATIAL RENDERING

BACKGROUND

Devices such as notebooks, desktop computers, mobile telephones, tablets, and other such devices may include speakers or utilize headphones to reproduce sound. The sound emitted from such devices may be subject to various processes that modify the sound quality.

BRIEF DESCRIPTION OF DRAWINGS

Features of the present disclosure are illustrated by way of example and not limited in the following figure(s), in which like numerals indicate like elements, in which.

DETAILED DESCRIPTION

Figure 1:
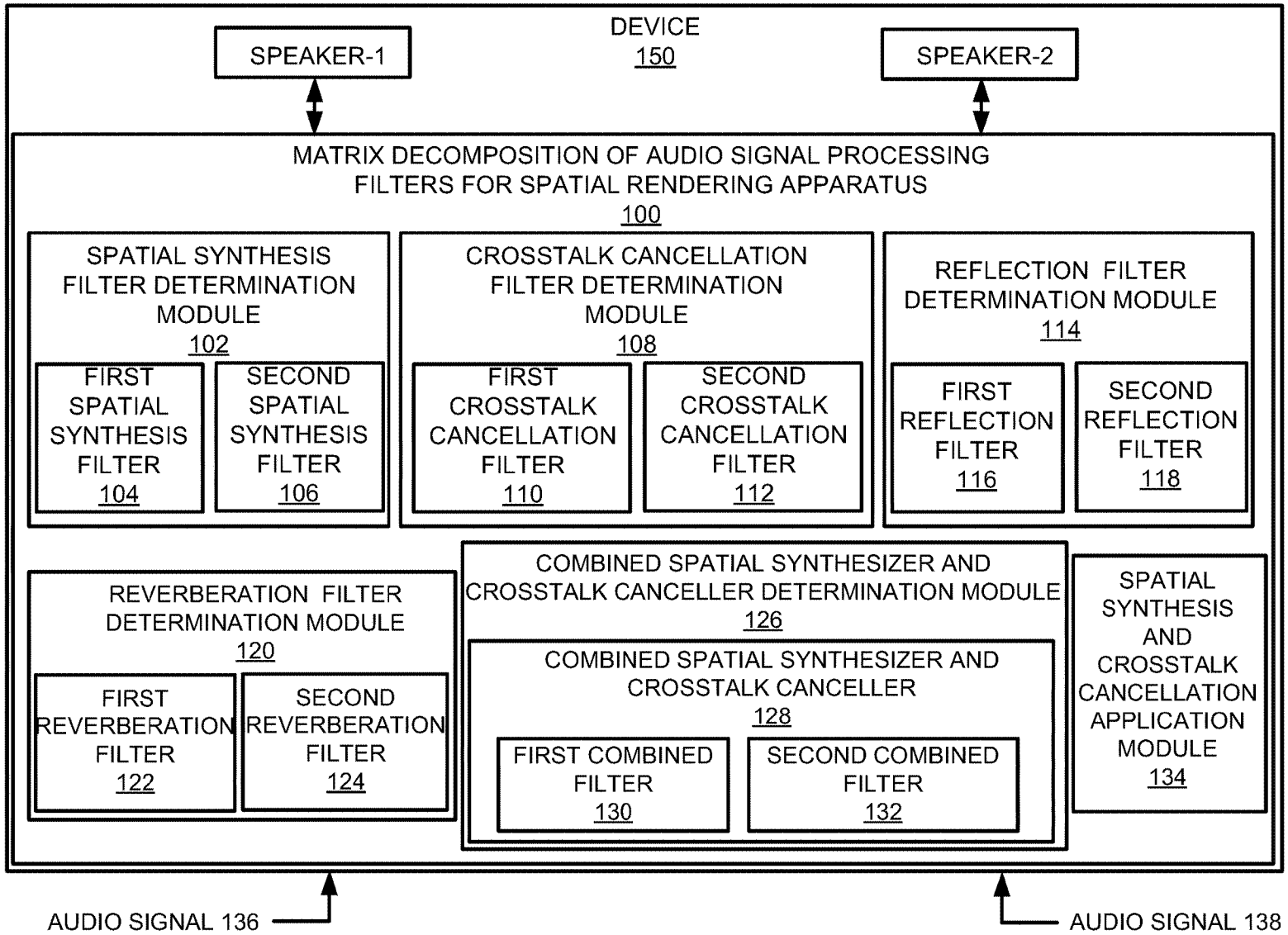
FIG. 1 illustrates an example layout of a matrix decomposition of audio signal processing filters for spatial rendering apparatus.

For simplicity and illustrative purposes, the present disclosure is described by referring mainly to examples. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure.

Throughout the present disclosure, the terms "a" and "an" are intended to denote at least one of a particular element. As used herein, the term "includes" means includes but not limited to, the term "including" means including but not limited to. The term "based on" means based at least in part on.

Matrix decomposition of audio signal processing filters for spatial rendering apparatuses, methods for matrix decomposition of audio signal processing filters for spatial rendering, and non-transitory computer readable media having stored thereon machine readable instructions to provide matrix decomposition of audio signal processing filters for spatial rendering are disclosed herein. The apparatuses, methods, and non-transitory computer readable media disclosed herein provide for decomposition of spatial rendering by combining crosstalk cancellation along with ipsilateral and contralateral filters derived from head-related transfer function (HRTF) measurements, and ipsilateral and contralateral filters representing reflections and reverberations. The apparatuses, methods, and non-transitory computer readable media disclosed herein provide for reduction of the number of filters (e.g., from 4, 8, 12, or any number of multiples of 4 filters to 2 filters), and hence reduction of the computational complexity for real-time rendering of audio signals by a factor of (4+2N), where N is the number of synthesized room reflections. The filters may be used, for example, for spatial rendering with direct sound and reflections using symmetric direct-sound HRTFs and reflections. In this regard, an HRTF may be described as a response that characterizes how an ear receives a sound from a point in space. A direct sound may be described as sound that is received directly from a sound source, such as a speaker. A reflection may be described as sound that is reflected from a source (e.g., a wall), based on direct sound emitted from a sound source, such as a speaker.

With respect to spatial rendering of audio signals, devices such as notebooks, desktop computers, mobile telephones, tablets, and other such devices may include speakers or utilize headphones to reproduce sound. Such devices may utilize a high-quality audio reproduction to create an immersive experience for cinematic and music content. The cinematic content may be multichannel (e.g., 5.1, 7.1, etc., where 5.1 represents "five point one" and includes a six channel surround sound audio system, 7.1 represents "seven point one" and includes an eight channel surround sound audio system, etc.). Elements that contribute towards a high-quality audio experience may include the frequency response (e.g., bass extension) of speakers or drivers, and proper equalization to attain a desired spectral balance. Other elements that contribute towards a high-quality audio experience may include artifact-free loudness processing to accentuate masked signals and improve loudness, and spatial quality that reflects artistic intent for stereo music and multichannel cinematic content.

With respect to spatial rendering with speakers, various filters may be applied to an input audio signal to produce high-quality spatial rendering. For example, the filters may include crosstalk cancellers, spatial synthesizers, reflection filters, reverberation filters, etc. Each of these filters may utilize a specified amount of processing resources. For battery operated devices, implementation of such filters may be limited based on the battery capacity of such devices. For non-battery operated devices (e.g., plug-in devices), implementation of such filters may be limited based on the processing capabilities of such devices.

In order to address at least these technical challenges associated with implementation of filters for production of high-quality spatial rendering, the apparatuses, methods, and non-transitory computer readable media disclosed herein provide matrix decomposition of audio signal processing filters for spatial rendering based on determination of first and second spatial synthesis filters (e.g., $(H_{11}^{0}+H_{12}^{0})$ and $(H_{11}^{0}-H_{12}^{0})$, as disclosed herein) respectively as a sum and a difference of ipsilateral (e.g., $H_{11}^0$, as disclosed herein) and contralateral (e.g., $H_{12}^0$, as disclosed herein) spatial synthesis filters. Further, the apparatuses, methods, and non-transitory computer readable media disclosed herein provide matrix decomposition of audio signal processing filters for spatial rendering based on determination of first and second crosstalk cancellation filters (e.g., $(H_{11}+H_{12})$ and $(H_{11}-H_{12})$, as disclosed herein) respectively as a sum and a difference of ipsilateral (e.g., $H_{11}$, as disclosed herein) and contralateral (e.g., $H_{12}$, as disclosed herein) crosstalk cancellation filters. Based on application of matrix decomposition on the first and second spatial synthesis filters and the first and second crosstalk cancellation filters, a combined spatial synthesizer and crosstalk canceller that includes a first combined filter (e.g., $F_0(z)$, as disclosed herein) and a second combined filter (e.g., $\tilde{F}_0(z)$, as disclosed herein) may be determined. Further, spatial synthesis and crosstalk cancellation may be performed on first and second input audio signals based on application of the combined spatial synthesizer and crosstalk canceller.

For the apparatuses, methods, and non-transitory computer readable media disclosed herein, modules, as described herein, may be any combination of hardware and programming to implement the functionalities of the respective modules. In some examples described herein, the combinations of hardware and programming may be implemented in a number of different ways. For example, the programming for the modules may be processor executable instructions stored on a non-transitory machine-readable storage medium and the hardware for the modules may include a processing resource to execute those instructions. In these examples, a computing device implementing such modules may include the machine-readable storage medium storing the instructions and the processing resource to execute the instructions, or the machine-readable storage medium may be separately stored and accessible by the computing device and the processing resource. In some examples, some modules may be implemented in circuitry.

FIG. 1 illustrates an example layout of a matrix decomposition of audio signal processing filters for spatial rendering apparatus (hereinafter also referred to as "apparatus 100").

In some examples, the apparatus 100 may include or be provided as a component of a device such as a notebook, a desktop computer, a mobile telephone, a tablet, and other such devices. For the example of FIG. 1, the apparatus 100 is illustrated as being provided as a component of a device 150, which may include a notebook, a desktop computer, a mobile telephone, a tablet, and other such devices. In some examples, a combined spatial synthesizer and crosstalk canceller generated by the apparatus 100 as disclosed herein may be provided as a component of the device 150 (e.g., see FIG. 2), without other components of the apparatus 100.

Referring to FIG. 1, the apparatus 100 may include a spatial synthesis filter determination module 102 to determine a first spatial synthesis filter 104 (e.g., $(H_{11}^0+H_{12}^0)$) as a sum of an ipsilateral spatial synthesis filter (e.g., $H_{11}^0$) and a contralateral spatial synthesis filter (e.g., $H_{12}^0$). Further, the spatial synthesis filter determination module 102 is to determine a second spatial synthesis filter 106 (e.g., $(H_{11}^0-H_{12}^0)$) as a difference of the ipsilateral spatial synthesis filter and the contralateral spatial synthesis filter.

According to an example, as disclosed herein, the first and second spatial synthesis filters may be reduced, based on the application of matrix decomposition by the spatial synthesis filter determination module 102, from four spatial synthesis filters that include two ipsilateral spatial synthesis filters and two contralateral spatial synthesis filters to two spatial synthesis filters that include one ipsilateral spatial synthesis filter and one contralateral spatial synthesis filter.

A crosstalk cancellation filter determination module 108 is to determine a first crosstalk cancellation filter 110 (e.g., $(H_{11}+H_{12})$) as a sum of an ipsilateral crosstalk cancellation filter (e.g., $H_{11}$) and a contralateral crosstalk cancellation filter (e.g., $H_{12}$). Further, the crosstalk cancellation filter determination module 108 is to determine a second crosstalk cancellation filter 112 (e.g., $(H_{11}-H_{12})$) as a difference of the ipsilateral crosstalk cancellation filter and the contralateral crosstalk cancellation filter.

According to an example, as disclosed herein, the first and second crosstalk cancellation filters may be reduced, based on the application of matrix decomposition by the crosstalk cancellation filter determination module 112, from four crosstalk cancellation filters that include two ipsilateral crosstalk cancellation filters and two contralateral crosstalk cancellation filters to two crosstalk cancellation filters that include one ipsilateral crosstalk cancellation filter and one contralateral crosstalk cancellation filter.

A reflection filter determination module 114 is to determine a first reflection filter 116 (e.g., $(H_{11}^1+H_{12}^1)$) as a sum of an ipsilateral reflection filter (e.g., $H_{11}^1$) and a contralateral reflection filter (e.g., $H_{12}^1$). Further, the reflection filter determination module 114 is to determine a second reflection filter 118 (e.g., $(H_{11}^1-H_{12}^1)$) as a difference of the ipsilateral reflection filter and the contralateral reflection filter.

A reverberation filter determination module 120 is to determine a first reverberation filter 122 (e.g., $(H_{11}^2+H_{12}^2)$) as a sum of an ipsilateral reverberation filter (e.g., $H_{11}^2$) and a contralateral reverberation filter (e.g., $H_{12}^2$). Further, the reverberation filter determination module 120 is to determine a second reverberation filter 124 (e.g., $(H_{11}^2-H_{12}^2)$) as a difference of the ipsilateral reverberation filter and the contralateral reverberation filter.

In this manner, other filters may be determined in a similar manner as disclosed herein with respect to the spatial synthesis filter determination module 102, the crosstalk cancellation filter determination module 108, the reflection filter determination module 114, and the reverberation filter determination module 120.

With respect to the reflection filter determination module 114, the first and second reflection filters may be reduced, based on the application of the matrix decomposition, from four corresponding reflection filters that include two ipsilateral reflection filters and two contralateral reflection filters to two reflection filters that include one ipsilateral reflection filter and one contralateral reflection filter.

Similarly, with respect to the reverberation filter determination module 120, the first and second reverberation filters may be reduced, based on the application of the matrix decomposition, from four corresponding reverberation filters that include two ipsilateral reverberation filters and two contralateral reverberation filters to two reverberation filters that include one ipsilateral reverberation filter and one contralateral reverberation filter.

According to an example, the spatial synthesis filters may include the reflection filters and the reverberation filters.

A combined spatial synthesizer and crosstalk canceller determination module 126 is to determine, based on application of matrix decomposition to the first and second spatial synthesis filters and the first and second crosstalk cancellation filters, a combined spatial synthesizer and crosstalk canceller 128 that includes a first combined filter 130 and a second combined filter 132.

With respect to the first reflection filter 116 and the second reflection filter 118, and/or the first reverberation filter 122 and the second reverberation filter 124, the combined spatial synthesizer and crosstalk canceller determination module 126 is to determine, based on application of matrix decomposition to the first and second spatial synthesis filters, and the first and second crosstalk cancellation filters, and further the first and second reflection filters and/or the first and second reverberation filters, the combined spatial synthesizer and crosstalk canceller 128 that includes the first combined filter 130 and the second combined filter 132.

According to an example, the first combined filter 130 and the second combined filter 132 may reduce, based on the application of the matrix decomposition, a total number of filters for the apparatus 100 by a factor of four plus two times a number of synthesized reflections (e.g., (4+2N), where N is the number of synthesized room reflections).

A spatial synthesis and crosstalk cancellation application module 134 is to perform, based on application of the combined spatial synthesizer and crosstalk canceller 128, spatial synthesis and crosstalk cancellation on first and second input audio signals 136 and 138, respectively.

Figure 2:
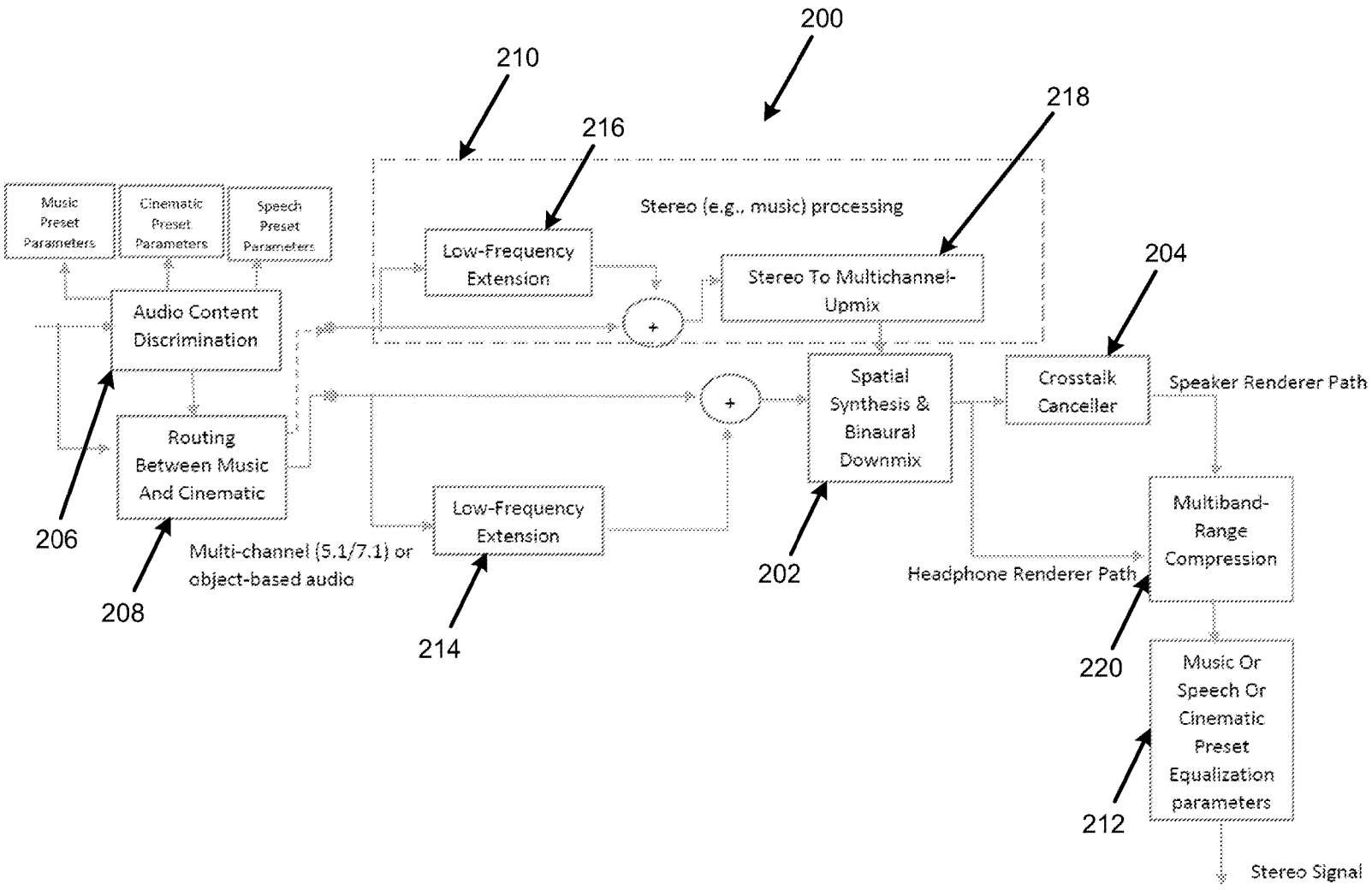
FIG. 2 illustrates an example layout of an immersive audio renderer.

FIG. 2 illustrates an example layout of an immersive audio renderer 200.

Referring to FIG. 2, the apparatus 100 may be implemented in the immersive audio renderer 200 of FIG. 2. The immersive audio renderer 200 may provide for integration in consumer, commercial and mobility devices, in the context of multichannel content (e.g., cinematic content). For example, the immersive audio renderer 200 may be integrated in a device such as a notebook, a desktop computer, a mobile telephone, a tablet, and other such devices.

The immersive audio renderer 200 may be extended to accommodate next-generation audio formats (including channel/objects or pure object-based signals and metadata) as input to the immersive audio renderer 200. For the immersive audio renderer 200, in the case of loudspeaker rendering, the combined spatial synthesizer and crosstalk canceller 128 may replace the individual blocks comprising the spatial synthesis component of the spatial synthesis and binaural downmix block at 202, and the crosstalk canceller block at 204. In the case of headphone rendering, the crosstalk canceller block at 204 may be bypassed and a combined spatial synthesizer block may replace the cascade of direct sound (HRTF) ipsilateral and contralateral filters, reflections ipsilateral and contralateral filters, and ipsilateral and contralateral reverberation filters.

For the immersive audio renderer 200, reflections and desired direction sounds may be mixed in prior to crosstalk cancellation at the spatial synthesis and binaural downmix block at 202. For example, the spatial synthesis and binaural downmix 202 may apply HRTFs to render virtual sources at desired angles (and distances). According to an example, the HRTFS may be for angles +/−40° for the front left and front right sources (channels), 0° for the center, and +/−110° degrees for the left and right surround sources (channels).

For the immersive audio renderer 200, the crosstalk canceller block at 204 will be described in further detail with reference to FIG. 3.

For the immersive audio renderer 200, the audio content discrimination block at 206 may provide for discrimination between stereo and multichannel content in order to deliver the appropriate content to the appropriate processing blocks. The output of the audio content discrimination block at 206, when identified as stereo (e.g., music), may be routed by block 208 to the processing elements in the dotted box at 210 as stereo music processing. Alternatively, the output, when identified as multichannel or object based content, may be routed to the multichannel processing blocks (e.g., blocks outside of the dotted box at 210). Furthermore, appropriate presets may be loaded from memory and applied at the output stage at 212 as equalization or spatial settings for the processing depending on the type of content (e.g., music, speech, cinematic, etc.) and the type of device-centric rendering (e.g., loudspeakers, headphones, etc., where for headphones, a database of headphone filters may be pre-loaded and subsequently retrieved from memory).

The low-frequency extension block at 214 (and similarly at 216) may perform psychoacoustically motivated low-frequency extension (for speakers or drivers incapable of reproducing low-frequencies due to their size) by knowing the loudspeaker characteristics and the analysis of signal spectrum. The output of the low-frequency extension block at 214 may be adapted to filter nonlinearly synthesized harmonics. The low-frequency extension block at 214 may perform a synthesis of non-linear terms of a low pass audio signal in a side chain. Specifically auditory motivated filterbanks filter an audio signal, the peak of the audio signal may be tracked in each filterbank, and the maximum peak over all peaks or each of the peaks may be selected for nonlinear term generation. The nonlinear terms for each filterbank output may then be band pass filtered and summed into each of the channels to create the perception of low frequencies.

Prior to performing spatial rendering of music, the stereo-to-multichannel upmix block at 218 may perform a stereo upmix.

The multiband-range compression block at 220 may perform multiband compression, for example, by using perfect reconstruction (PR) filterbanks, an International Telecommunication Union (ITU) loudness model, and a neural network to generalize to arbitrary multiband dynamic range compression (DRC) parameter settings.

Figure 3:
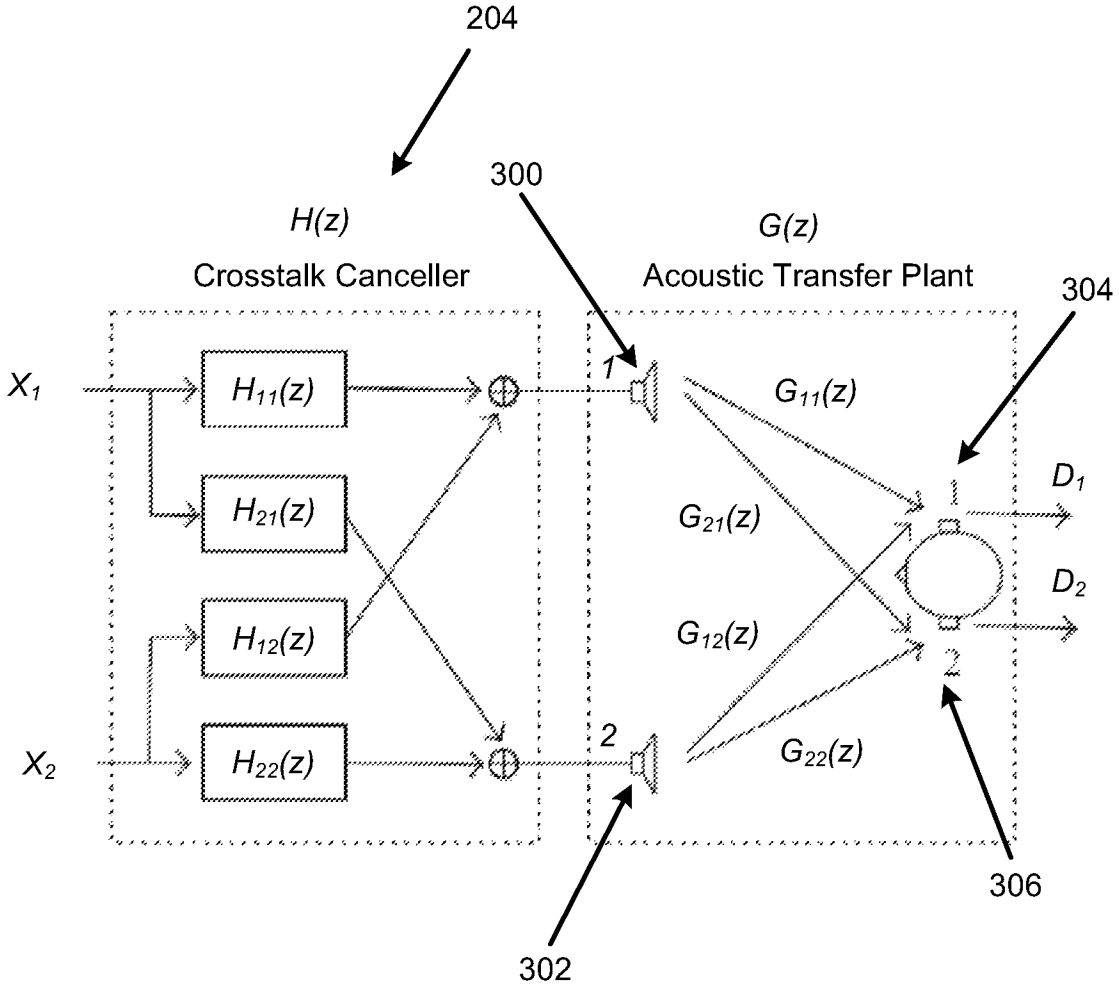
FIG. 3 illustrates an example layout of a crosstalk canceller and a binaural acoustic transfer function.

FIG. 3 illustrates an example layout of the crosstalk canceller 204 and a binaural acoustic transfer function.

The crosstalk canceler 204 may be used to perform equalization of the ipsilateral signals (loudspeaker to same side ear) and cancel out contralateral crosstalk (loudspeaker to opposite side ear). FIG. 3 shows the crosstalk canceler 204 for canceling the crosstalk at the two ears (viz., reproducing left-channel program at the left ear and the right-channel program at the right-ear).

Referring to FIG. 3, for the crosstalk canceller 204, the acoustic path ipsilateral responses $G_{11}(z)$ and $G_{22}(z)$ (e.g., same-side speaker as the ear) and contralateral responses $G_{12}(z)$ and $G_{21}(z)$ (e.g., opposite-side speaker as the ear) may be determined based on the distance and angle of the ears to the speakers. For example, FIG. 3 illustrates speakers 300 and 302, respectively also denoted speaker-1 and speaker-2 in FIG. 1. Further, a user's ears corresponding to the destinations 304 and 306 may be respectively denoted as ear-1 and ear-2. In this regard $G_{11}(z)$ may represent the transfer function from speaker-1 to ear-1, $G_{22}(z)$ may represent the transfer function from speaker-2 to ear-2, and $G_{12}(z)$ and $G_{21}(z)$ may represent the crosstalks. The crosstalk canceller. 204 may be denoted by the matrix H(z), which may be designed to send a signal $X_1$ to ear-1, and a signal $X_2$ to ear-2. For the example of FIG. 3, the angle of the ears to the speakers 300 and 302 may be specified as 15° relative to a median plane, where devices such as notebooks, desktop computers, mobile telephones, etc., may include speakers towards the end or edges of a screen.

For the example layout of the crosstalk canceller and the binaural acoustic transfer function of FIG. 3, the acoustic responses (viz., the $G_{ij}(z)$ for the source angles) may include the HRTFs corresponding to ipsilateral and contralateral transfer paths. The HRTFs may be obtained from an HRTF database, such as an HRTF database from the Institute for Research and Coordination in Acoustics/Music (IRCAM).

Figure 4:
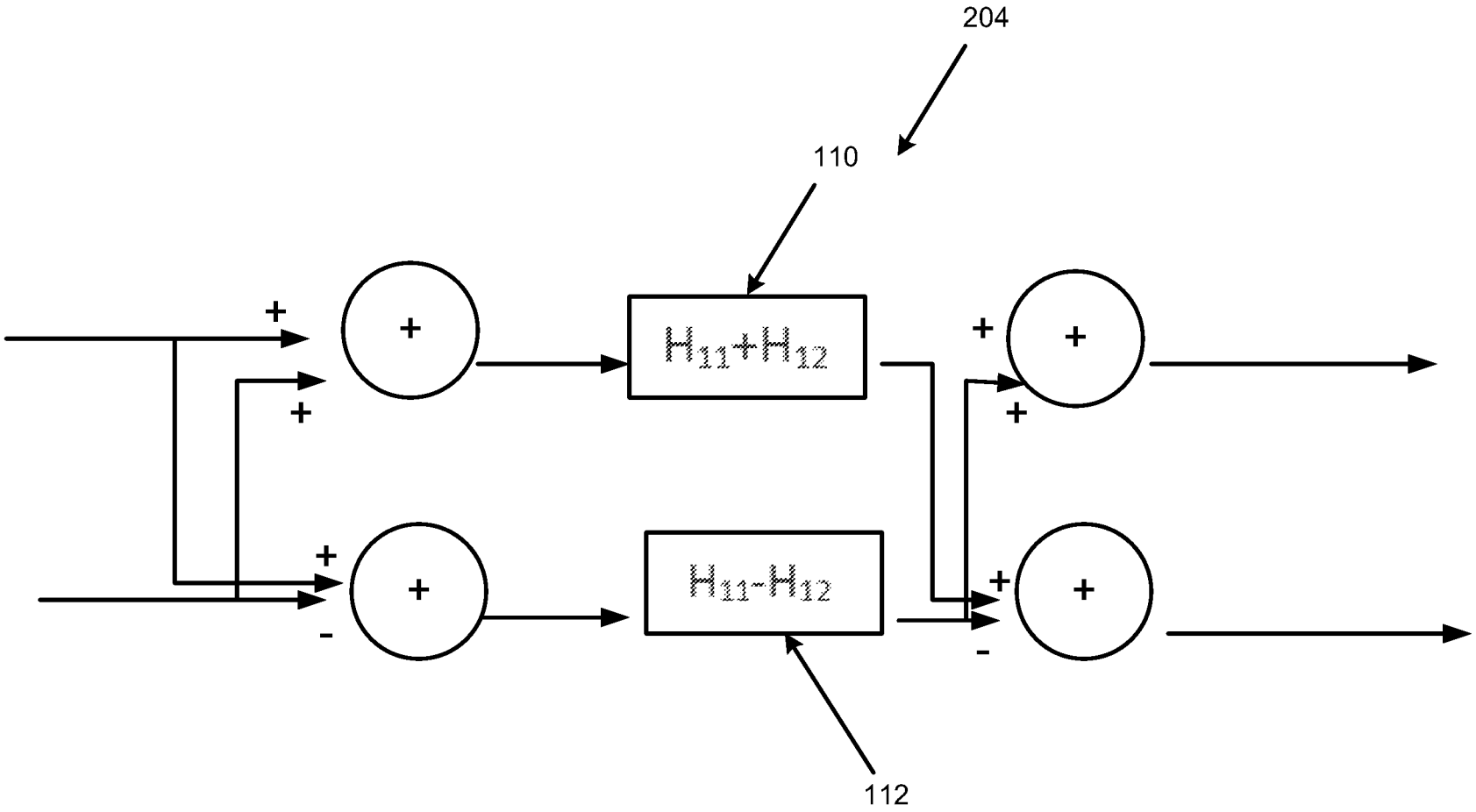
FIG. 4 illustrates an example layout of a crosstalk canceller with matrix decomposition.

FIG. 4 illustrates an example layout of the crosstalk canceller 204 with matrix decomposition.

Referring to FIGS. 3 and 4, instead of using four-filters (e.g., $H_{11}$, $H_{22}$, $H_{12}$, and $H_{21}$, with two of these in a pair being the same, $H_{11}=H_{22}$, $H_{12}=H_{21}$ due to symmetricity of the loudspeakers relative to center listening position) for crosstalk cancellation, the crosstalk cancellation filter determination module 108 may determine the first crosstalk cancellation filter 110 (e.g., $(H_{11}+H_{12})$) as a sum of the ipsilateral crosstalk cancellation filter (e.g., $H_{11}$) and the contralateral crosstalk cancellation filter (e.g., $H_{12}$). Further, the crosstalk cancellation filter determination module 108 may determine the second crosstalk cancellation filter 112 (e.g., $(H_{11}-H_{12})$) as a difference of the ipsilateral crosstalk cancellation filter and the contralateral crosstalk cancellation filter as follows:

$$\begin{pmatrix} H_{11}(z) & H_{12}(z) \\ H_{21}(z) & H_{22}(z) \end{pmatrix} = \begin{pmatrix} H_{11}(z) & H_{12}(z) \\ H_{12}(z) & H_{11}(z) \end{pmatrix} = \begin{pmatrix} 1 & 1 \\ 1 & -1 \end{pmatrix} \begin{pmatrix} H_{11}(z)+H_{12}(z) & 0 \\ 0 & H_{11}(z)-H_{12}(z) \end{pmatrix} \begin{pmatrix} 1 & 1 \\ 1 & -1 \end{pmatrix} \quad \text{Equation (1)}$$

Thus, referring to FIG. 4, the resulting crosstalk canceller 204 may be implemented based on signal manipulations.

Figure 5:
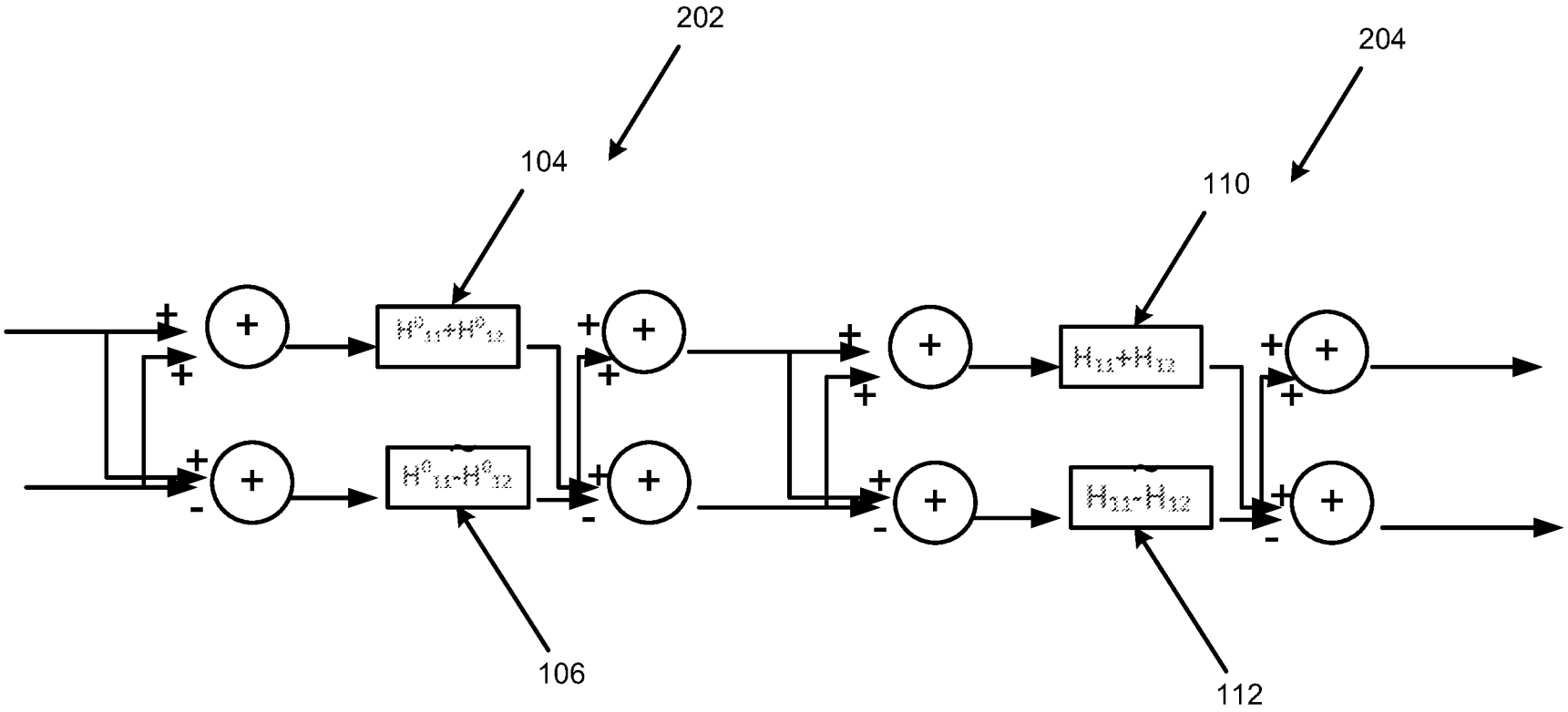
FIG. 5 illustrates an example layout of an individual spatial synthesizer and an individual crosstalk canceller with matrix decomposition.

FIG. 5 illustrates an example layout of an individual spatial synthesizer (e.g., the spatial synthesis component of the spatial synthesis and binaural downmix block at 202) and an individual crosstalk canceller 204 with matrix decomposition. In this regard, the spatial synthesis filter determination module 102 may determine the first spatial synthesis filter 104 (e.g., $(H_{11}^0+H_{12}^0)$) as a sum of the ipsilateral spatial synthesis filter (e.g., $H_{11}^0$) and the contralateral spatial synthesis filter (e.g., $H_{12}^0$). Further, the spatial synthesis filter determination module 102 may determine the second spatial synthesis filter 106 (e.g., $(H_{11}^0-H_{12}^0)$) as a difference of the ipsilateral spatial synthesis filter and the contralateral spatial synthesis filter.

The spatial synthesis block (with symmetric filters $H_{11}^0(z)$, $H_{12}^0(z)$) may apply HRTFs to render virtual sources at desired angles (and distances), and may be used in conjunction with crosstalk-cancellation via matrix decomposition as shown in FIG. 5.

Figure 6:
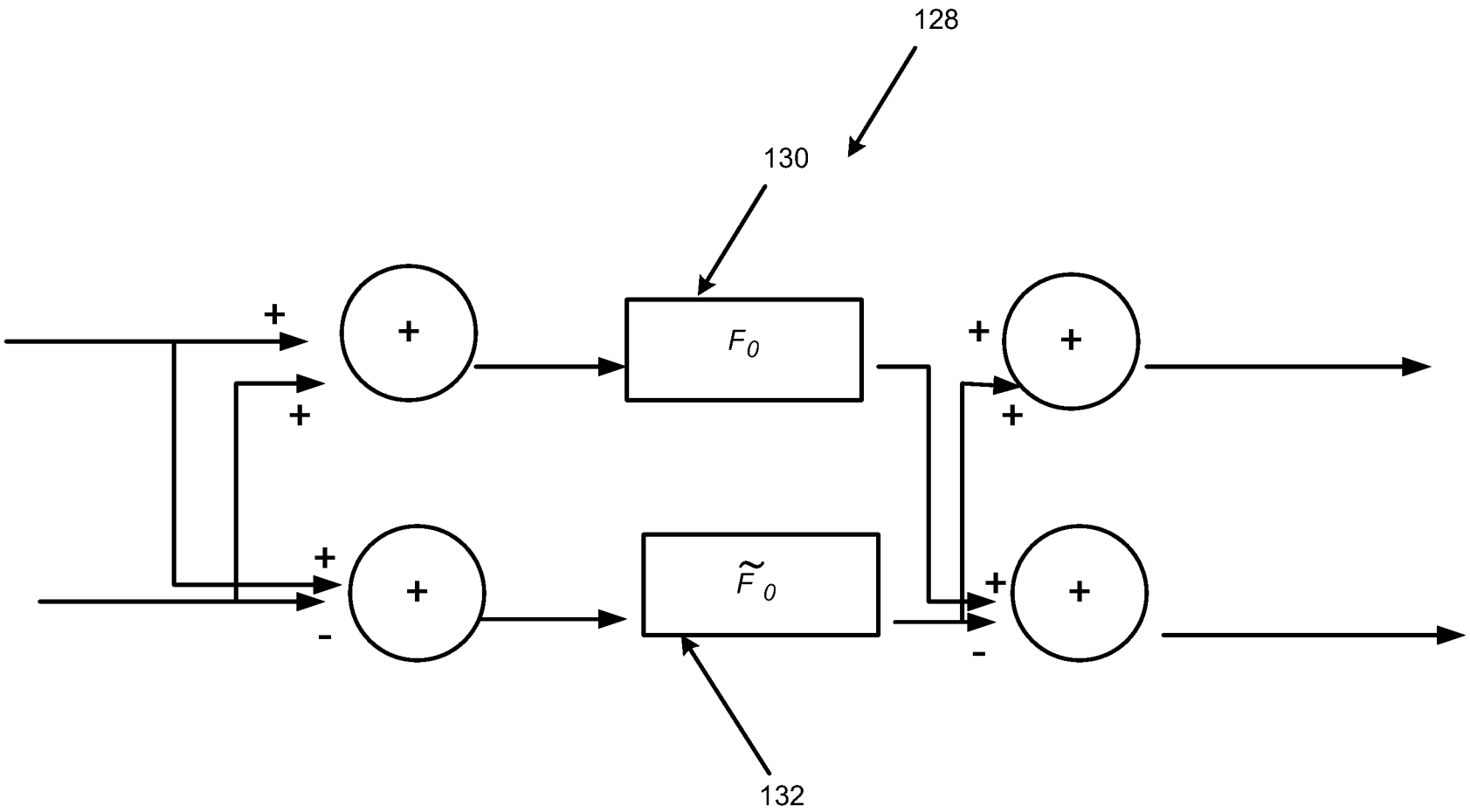
FIG. 6 illustrates an example layout of a combined spatial synthesizer and crosstalk canceller with matrix decomposition.

FIG. 6 illustrates an example layout of the combined spatial synthesizer and crosstalk canceller 128 with matrix decomposition.

With respect to FIG. 6, the combined spatial synthesizer and crosstalk canceller determination module 126 may determine, based on application of matrix decomposition to the first and second spatial synthesis filters and the first and second crosstalk cancellation filters, the combined spatial synthesizer and crosstalk canceller 128 that includes the first combined filter 130 and the second combined filter 132.

In order for the combined spatial synthesizer and crosstalk canceller determination module 126 to determine the first combined filter 130 and the second combined filter 132, the results of FIG. 5 may be expressed in cascaded matrix form to further reduce the number of filter blocks used as follows:

$$\begin{pmatrix} 1 & 1 \\ 1 & -1 \end{pmatrix} \begin{pmatrix} H_{11}(z)+H_{12}(z) & 0 \\ 0 & H_{11}(z)-H_{12}(z) \end{pmatrix} \begin{pmatrix} 1 & 1 \\ 1 & -1 \end{pmatrix} \times \begin{pmatrix} 1 & 1 \\ 1 & -1 \end{pmatrix} \begin{pmatrix} H_{11}^0(z)+H_{12}^0(z) & 0 \\ 0 & H_{11}^0(z)-H_{12}^0(z) \end{pmatrix} \begin{pmatrix} 1 & 1 \\ 1 & -1 \end{pmatrix} = \begin{pmatrix} 1 & 1 \\ 1 & -1 \end{pmatrix} \begin{pmatrix} 2F_0(z) & 0 \\ 0 & 2\tilde{F}_0(z) \end{pmatrix} \begin{pmatrix} 1 & 1 \\ 1 & -1 \end{pmatrix} \quad \text{Equation (2)}$$

For Equation (2), $F_0(z)=(H_{11}(z)+H_{12}(z))(H_{11}^0(z)+H_{12}^0(z))$ and $\tilde{F}_0(z)=(H_{11}(z)-H_{12}(z))(H_{11}^0(z)-H_{12}^0(z))$. Note, that the product in the z-domain (or frequency domain) of the transfer functions correspond to the convolution of the impulse responses as follows:

$$(H_{11}(z)+H_{12}(z))(H_{11}^0(z)+H_{12}^0(z)) \overset{z}{\leftrightarrow} (h_{11}(n)+h_{12}(n)) \otimes (h_{11}^0(n)+h_{12}^0(n)) = h_A(n) \quad \text{Equation (3)}$$

$$(H_{11}(z)-H_{12}(z))(H_{11}^0(z)-H_{12}^0(z)) \overset{z}{\leftrightarrow} (h_{11}(n)-h_{12}(n)) \otimes (h_{11}^0(n)-h_{12}^0(n)) = h_B(n) \quad \text{Equation (4)}$$

For Equations (3) and (4), the z-transforms (Fourier transform along the unit-circle) map from time to the complex z-domain and $\otimes$ represents the convolution operation in time. In this regard, fast convolution algorithms achieve this filtering in digital signal processing (DSP) or in any real-time audio processing toolbox. Thus eight filters (four in the crosstalk canceler 204 and four in the spatial synthesis and binaural downmix block at 202) may be transformed to two filters $h_A(n)$ and $h_B(n)$ and as depicted in FIG. 6.

When adding symmetric reflections (with delays and attenuation filters along with HRTFs for synthesis of reflections), and/or reverberations, the same process disclosed herein with respect to FIGS. 5 and 6 may be performed by the reflection filter determination module 114, the reverberation filter determination module 120, and other such modules for other filters. In this regard, the same process disclosed herein with respect to FIGS. 5 and 6 may be used to determine the first reflection filter 116, the second reflection filter 118, the first reverberation filter 122, and the second reverberation filter 124. Denoting $h_{i,j,k}$ as the impulse responses obtained from matrix decomposition of the k-th reflection (i=1, j={1,2}), the result may be expressed again as two filters for N-reflections as follows:

$$(h_{11}(n)+h_{12}(n)) \otimes \sum_{k=0}^{N} (h_{11,k}(n)+h_{12,k}(n)) = h_{A,N}(n) \quad \text{Equation (5)}$$

$$(h_{11}(n)+h_{12}(n)) \otimes \sum_{k=0}^{N} (h_{11,k}(n)+h_{12,k}(n)) = h_{B,N}(n) \quad \text{Equation (6)}$$

These two filters for Equations (5) and (6) may be pre-computed based on the design and then used in real-time processing. The two crosstalk filters $(h_{11}(n)+h_{12}(n))$ and $(h_{11}(n)-h_{12}(n))$ are shown distinct, but may be included in a combined format. Further, one reflection (viz., k=1) may be added as an example arriving from 30° below the horizontal (and 45° horizontal from the median plane) for HRTFs. The crosstalk cancellation filters may be derived for 15° speaker locations. The spatial synthesis filters may be for horizontal 45° (left and right).

Figure 7:
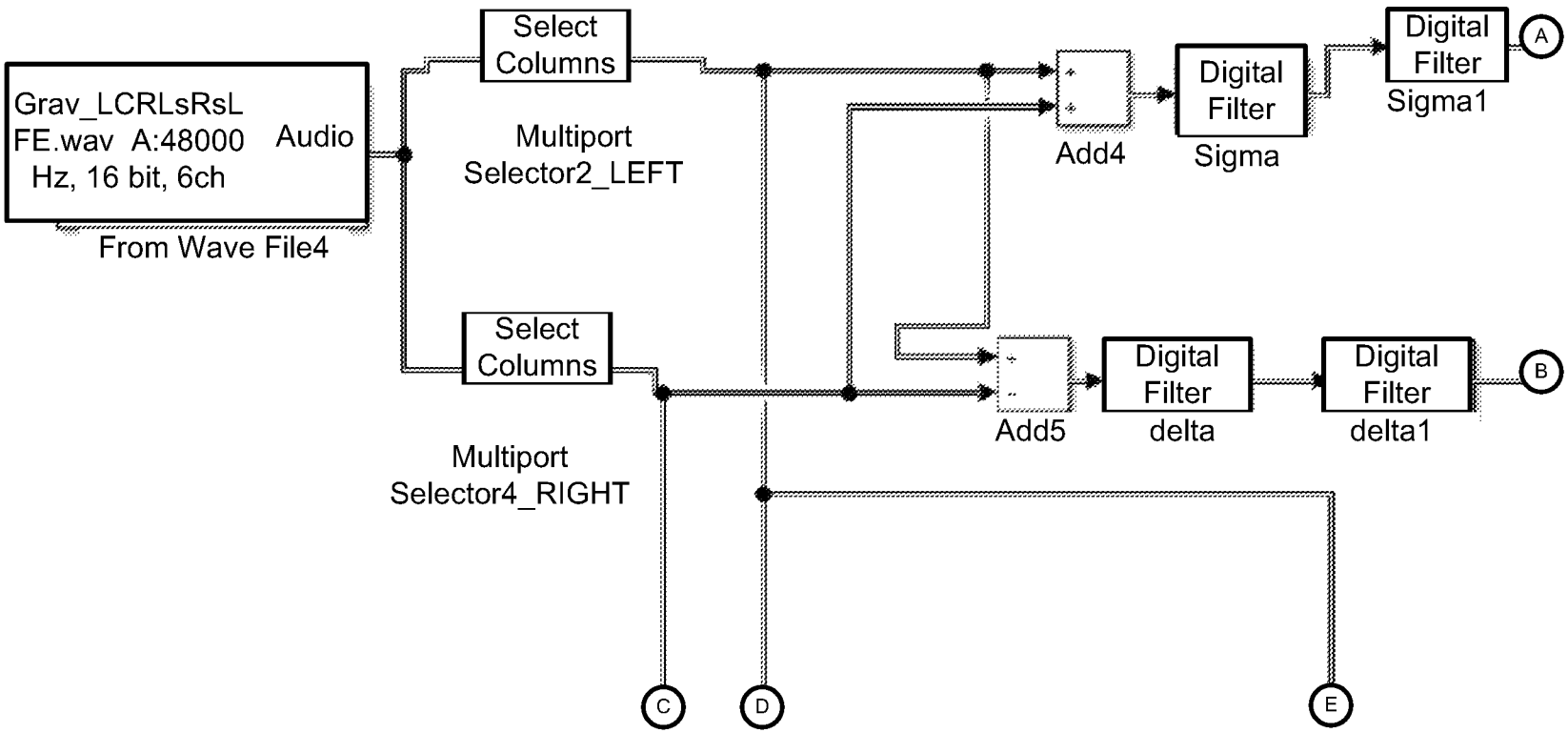
FIG. 7 illustrates an example implementation of the matrix decomposition of audio signal processing filters for spatial rendering apparatus of FIG. 1.
Figure 7:
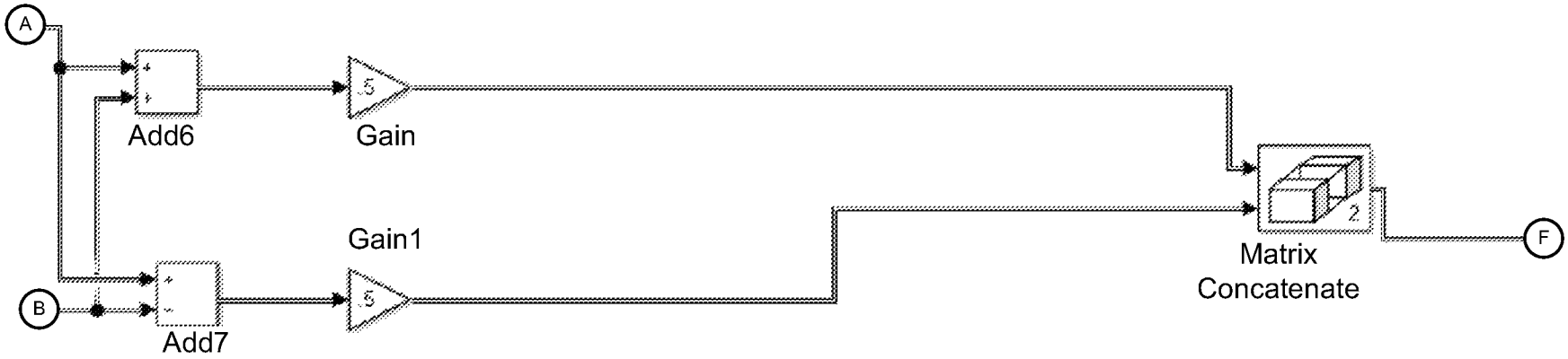
Figure 7:
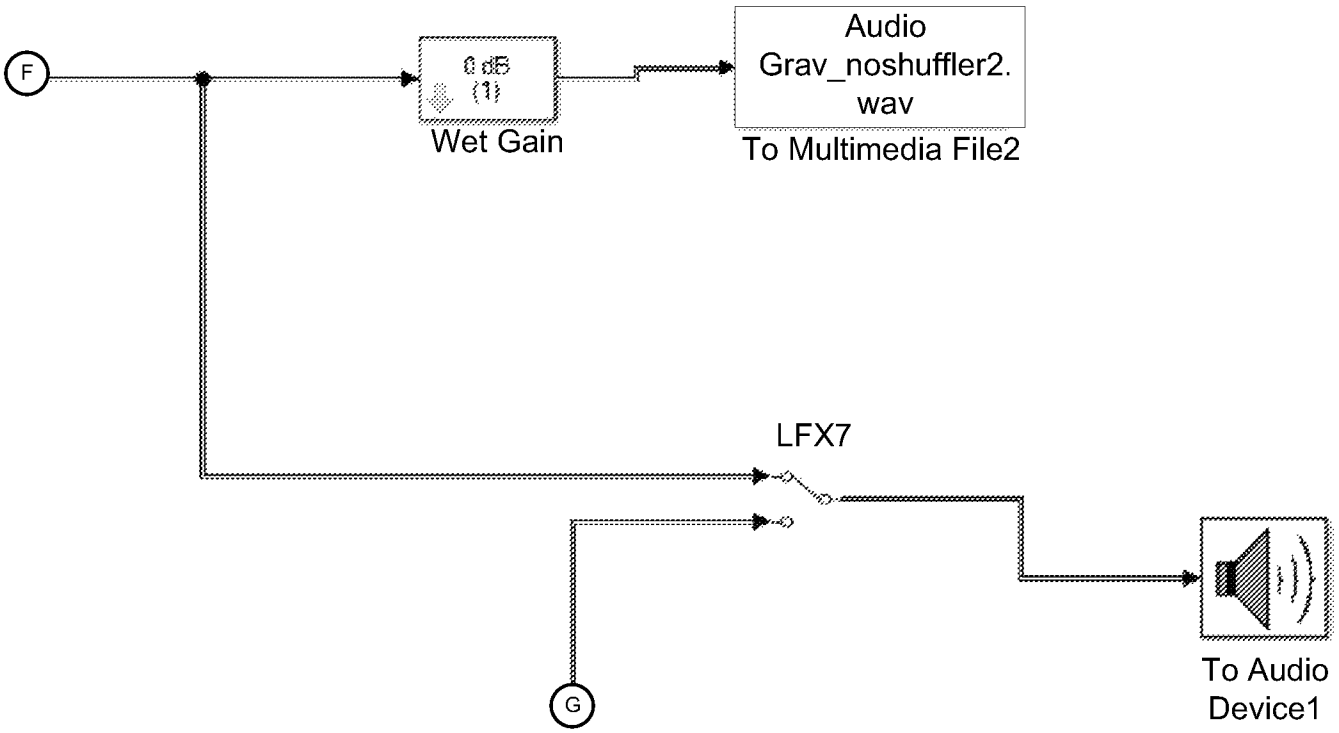
Figure 7:
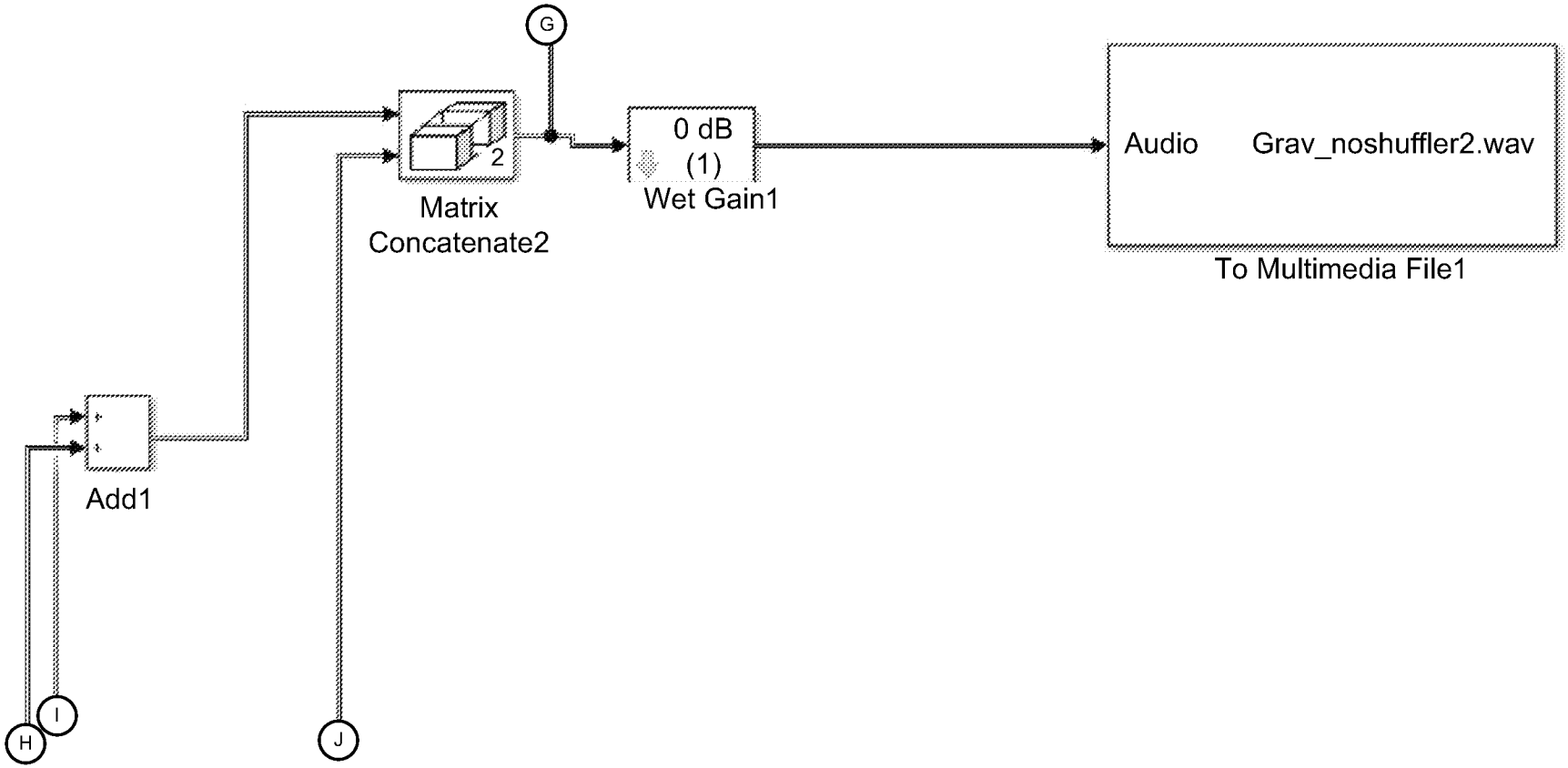
Figure 7:
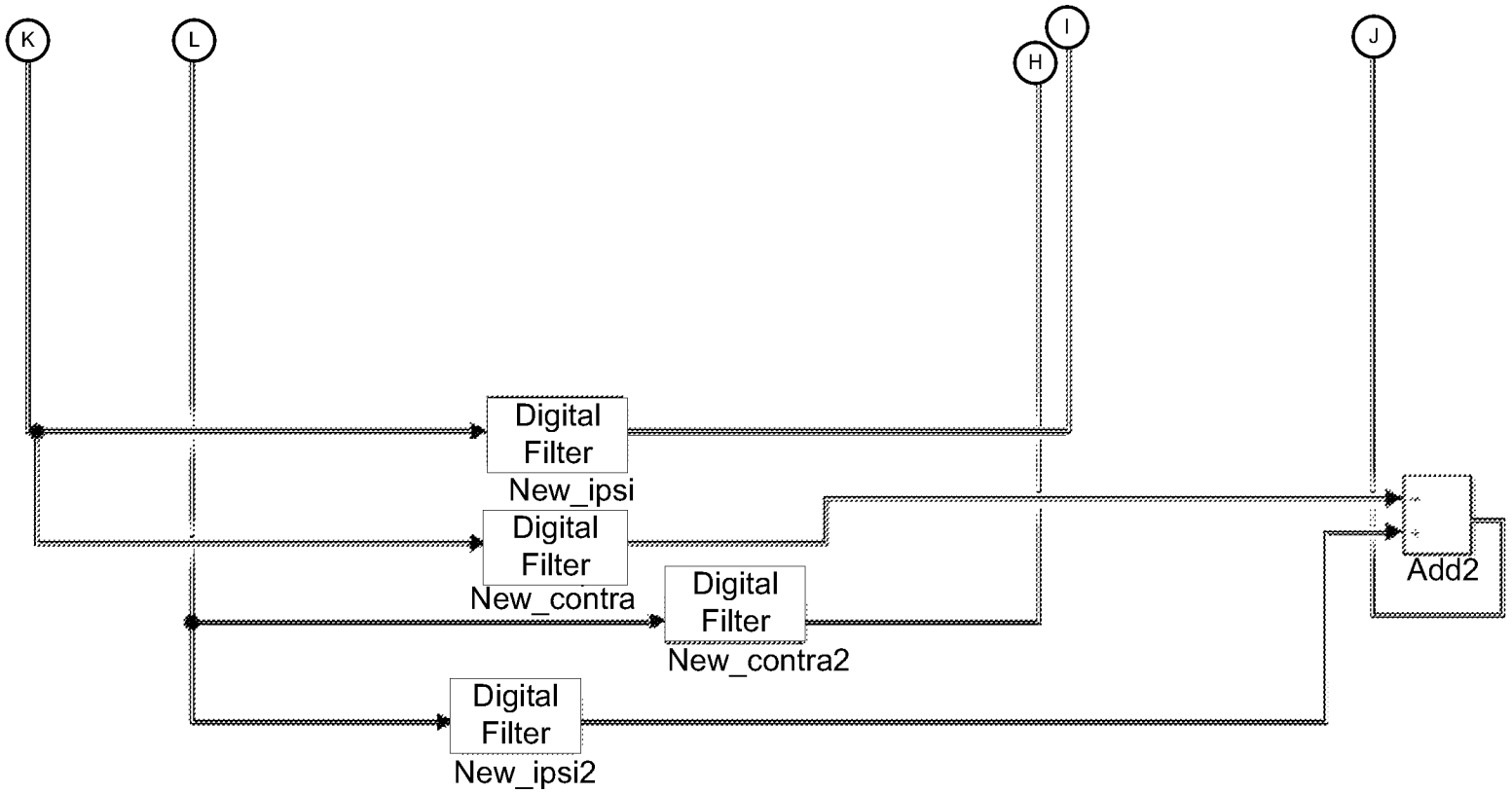
Figure 7:
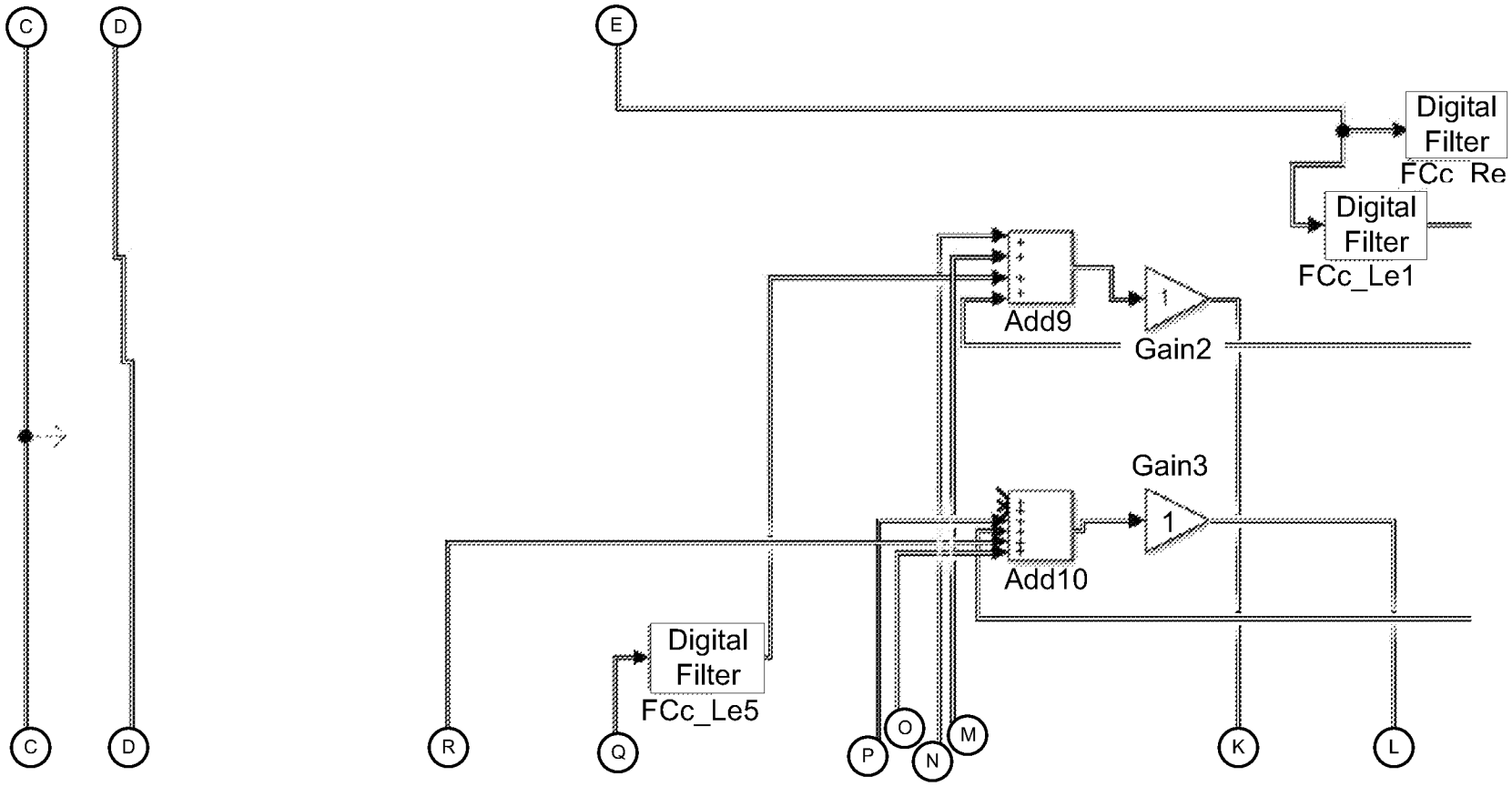
Figure 7:
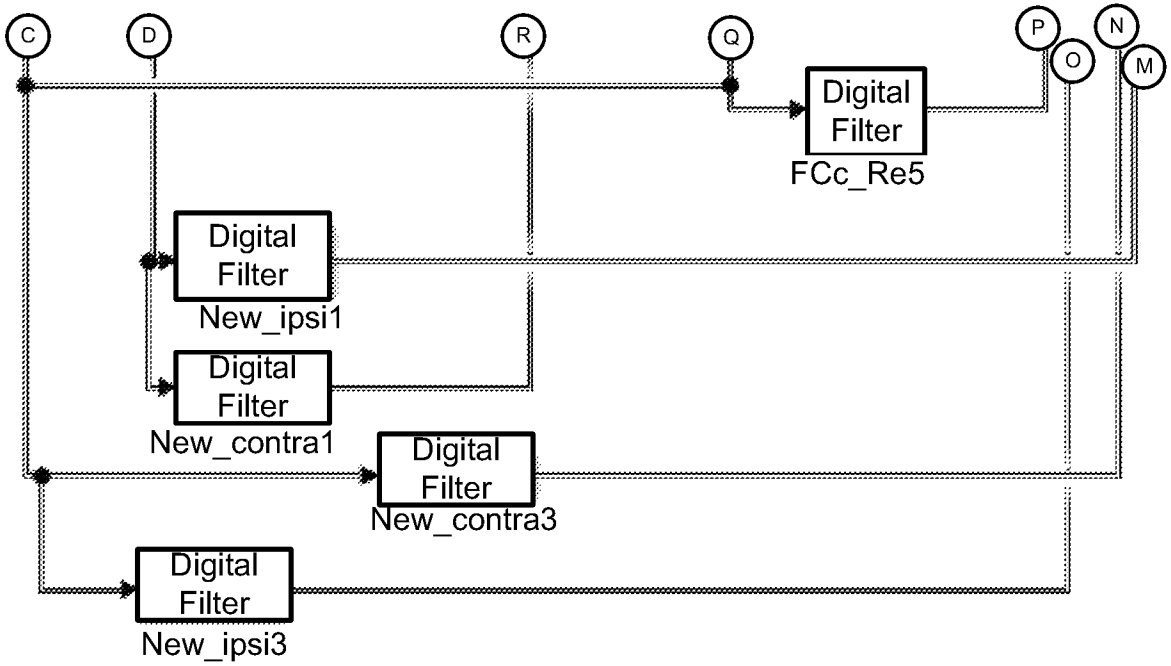

FIG. 7 illustrates an example implementation of the apparatus 100 of FIG. 1.

Referring to FIG. 7, the example implementation of the apparatus 100 of FIG. 1 may represent a SIMULINK™ implementation for the left and right channels (two-speaker case). In this regard, the two speakers may include the speaker-1 and the speaker-2 of FIG. 1. The SIMULINK™ implementation of FIG. 7 may be used to determine the error results of FIGS. 8A and 8B.

Figure 8A:
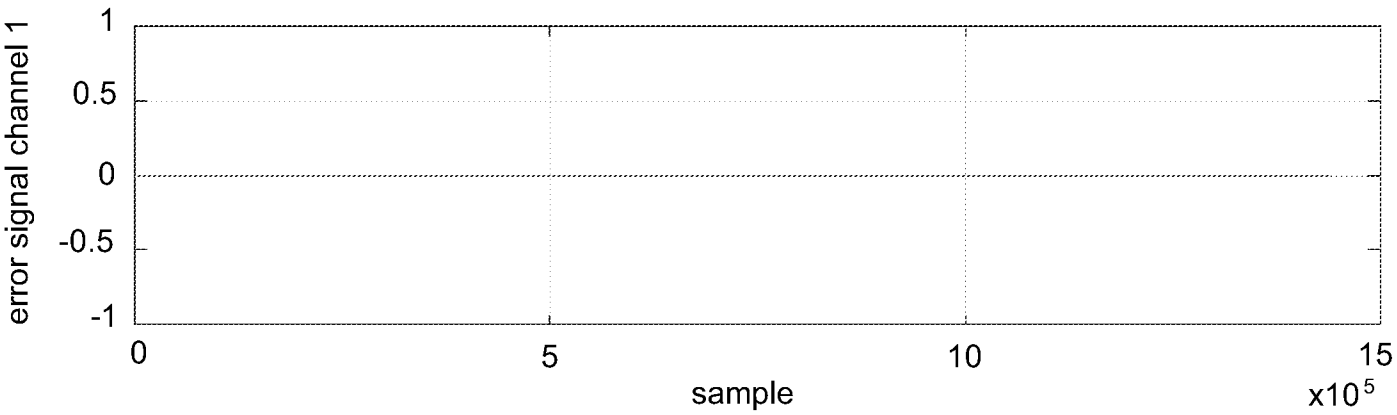
FIGS. 8A and 8B illustrate error results for comparison of operation of the matrix decomposition of audio signal processing filters for spatial rendering apparatus of FIG. 1 to an individual spatial synthesizer, an individual crosstalk canceller, and an individual reflection filter.
Figure 8B:
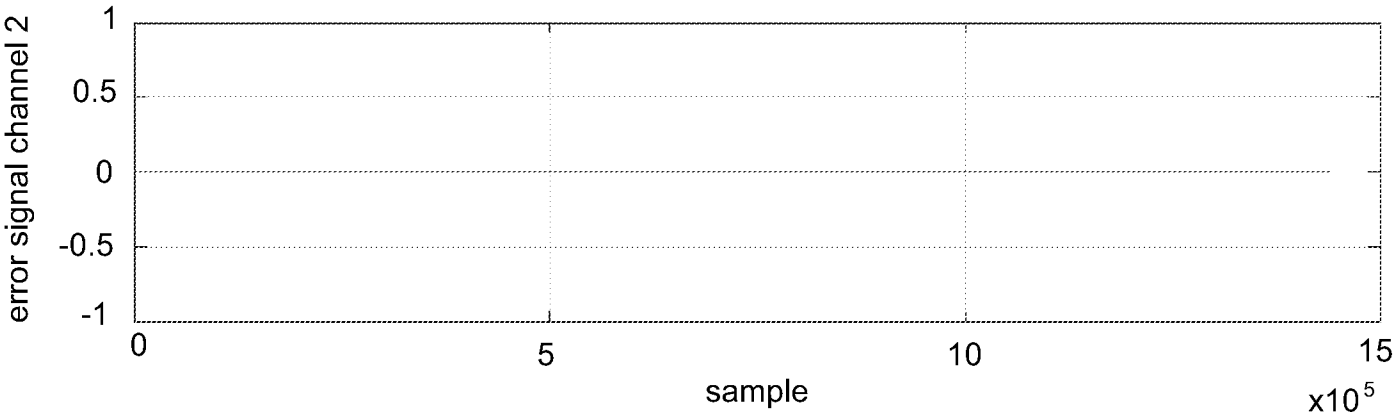

FIGS. 8A and 8B illustrate error results for comparison of operation of the apparatus 100 of FIG. 1 to an individual spatial synthesizer, an individual crosstalk canceller, and an individual reflection filter.

Referring to FIGS. 8A and 8B, the twelve total filters for the individual spatial synthesizer, the individual crosstalk canceller, and the individual reflection filter may be reduced to two filters including the first combined filter 130 and the second combined filter 132. As shown in FIGS. 8A and 8B, the error results for the twelve filters shown in FIG. 8A are identical to the error results for the two filters including the first combined filter 130 and the second combined filter 132.

Figure 9:
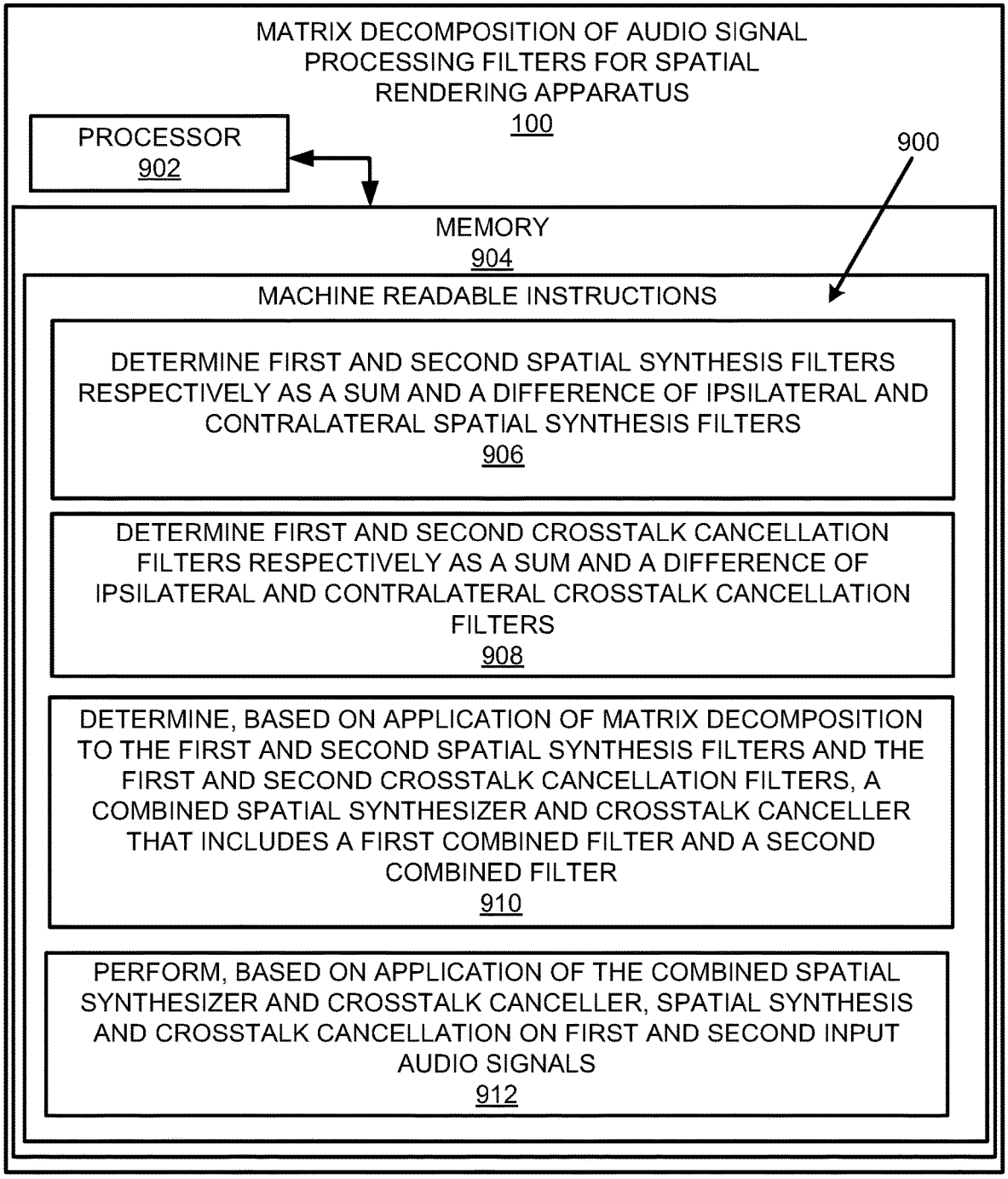
FIG. 9 illustrates an example block diagram for matrix decomposition of audio signal processing filters for spatial rendering.
Figure 10:
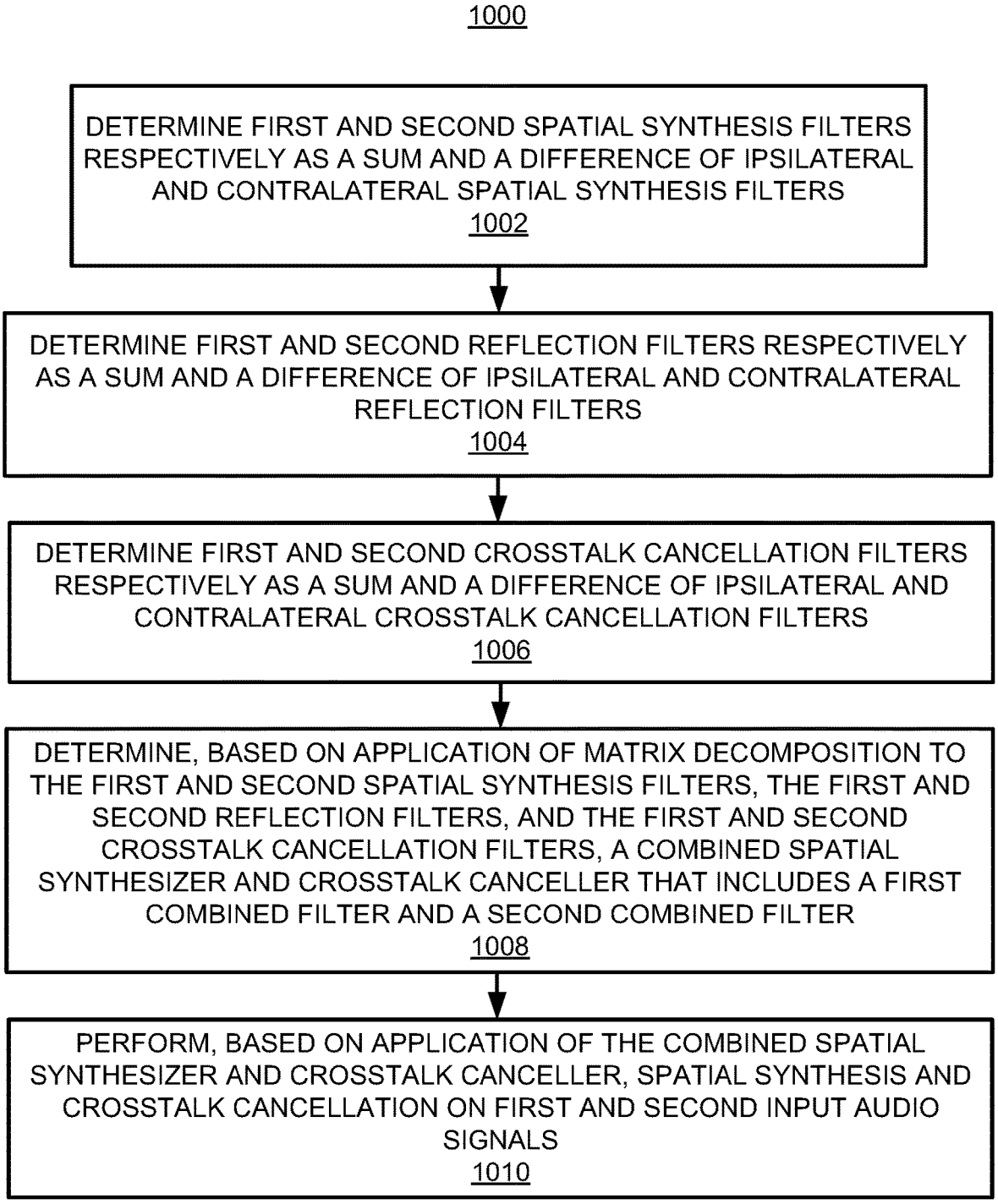
FIG. 10 illustrates an example flowchart of a method for matrix decomposition of audio signal processing filters for spatial rendering.
Figure 11:
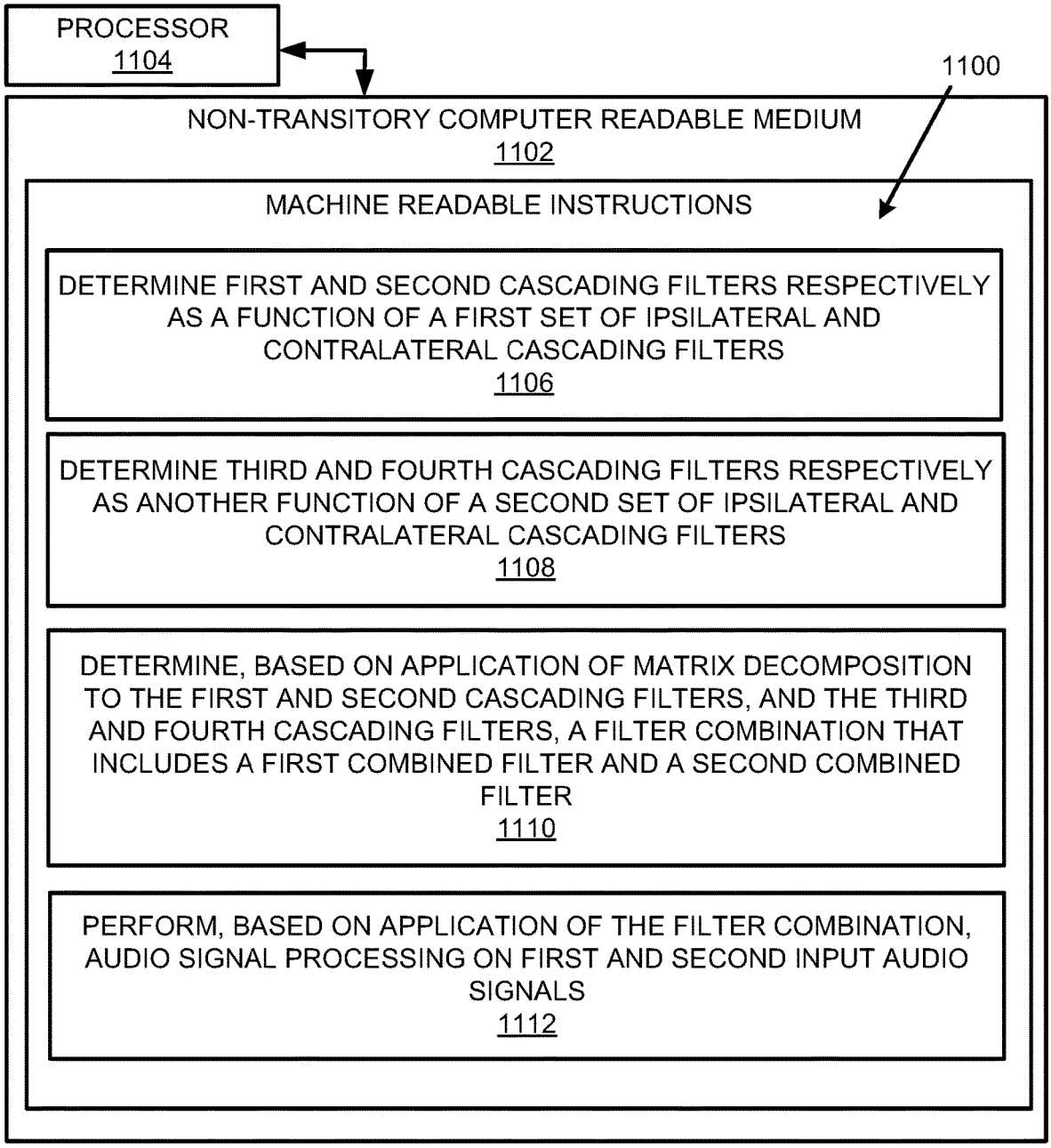
FIG. 11 illustrates a further example block diagram for matrix decomposition of audio signal processing filters for spatial rendering.

FIGS. 9-11 respectively illustrate an example block diagram 900, an example flowchart of a method 1000, and a further example block diagram 1100 for matrix decomposition of audio signal processing filters for spatial rendering. The block diagram 900, the method 1000, and the block diagram 1100 may be implemented on the apparatus 100 described above with reference to FIG. 1 by way of example and not limitation. The block diagram 900, the method 1000, and the block diagram 1100 may be practiced in other apparatus. In addition to showing the block diagram 900, FIG. 9 shows hardware of the apparatus 100 that may execute the instructions of the block diagram 900. The hardware may include a processor 902, and a memory 904 (i.e., a non-transitory computer readable medium) storing machine readable instructions that when executed by the processor cause the processor to perform the instructions of the block diagram 900. The memory 904 may represent a non-transitory computer readable medium. FIG. 10 may represent a method for matrix decomposition of audio signal processing filters for spatial rendering, and the steps of the method. FIG. 11 may represent a non-transitory computer readable medium 1102 having stored thereon machine readable instructions to provide matrix decomposition of audio signal processing filters for spatial rendering. The machine readable instructions, when executed, cause a processor 1104 to perform the instructions of the block diagram 1100 also shown in FIG. 11.

The processor 902 of FIG. 9 and/or the processor 1104 of FIG. 11 may include a single or multiple processors or other hardware processing circuit, to execute the methods, functions and other processes described herein. These methods, functions and other processes may be embodied as machine readable instructions stored on a computer readable medium, which may be non-transitory (e.g., the non-transitory computer readable medium 1102 of FIG. 11), such as hardware storage devices (e.g., RAM (random access memory), ROM (read only memory), EPROM (erasable, programmable ROM), EEPROM (electrically erasable, programmable ROM), hard drives, and flash memory). The memory 904 may include a RAM, where the machine readable instructions and data for a processor may reside during runtime.

Referring to FIGS. 1-9, and particularly to the block diagram 900 shown in FIG. 9, the memory 904 may include instructions 906 to determine first and second spatial synthesis filters 104 and 106 respectively as a sum and a difference of ipsilateral and contralateral spatial synthesis filters.

The processor 902 may fetch, decode, and execute the instructions 908 to determine first and second crosstalk cancellation filters 110 and 112 respectively as a sum and a difference of ipsilateral and contralateral crosstalk cancellation filters.

The processor 902 may fetch, decode, and execute the instructions 910 to determine, based on application of matrix decomposition to the first and second spatial synthesis filters and the first and second crosstalk cancellation filters, a combined spatial synthesizer and crosstalk canceller 128 that includes a first combined filter 130 and a second combined filter 132.

The processor 902 may fetch, decode, and execute the instructions 912 to perform, based on application of the combined spatial synthesizer and crosstalk canceller 128, spatial synthesis and crosstalk cancellation on first and second input audio signals 136 and 138, respectively.

Referring to FIGS. 1-9 and 10, and particularly FIG. 10, for the method 1000, at block 1002, the method may include determining first and second spatial synthesis filters 104 and 106 respectively as a sum and a difference of ipsilateral and contralateral spatial synthesis filters.

At block 1004, the method may include determining first and second reflection filters 116 and 118 respectively as a sum and a difference of ipsilateral and contralateral reflection filters.

At block 1006, the method may include determining first and second crosstalk cancellation filters 110 and 112 respectively as a sum and a difference of ipsilateral and contralateral crosstalk cancellation filters.

At block 1008, the method may include determining, based on application of matrix decomposition to the first and second spatial synthesis filters 104 and 106, the first and second reflection filters 116 and 118, and the first and second crosstalk cancellation filters 110 and 112, a combined spatial synthesizer and crosstalk canceller 128 that includes a first combined filter 130 and a second combined filter 132.

At block 1010, the method may include performing, based on application of the combined spatial synthesizer and crosstalk canceller 128, spatial synthesis and crosstalk cancellation on first and second input audio signals 136 and 138, respectively.

Referring to FIGS. 1-9 and 11, and particularly FIG. 11, for the block diagram 1100, the non-transitory computer readable medium 1102 may include instructions 1106 to determine first and second cascading filters (e.g., the filters 104 and 106, 110 and 112, 116 and 118, or 122 and 124) respectively as a function (e.g., a sum and a difference) of a first set of ipsilateral and contralateral cascading filters.

The processor 1104 may fetch, decode, and execute the instructions 1108 to determine third and fourth cascading filters (e.g., a remaining filter set from the filters 104 and 106, 110 and 112, 116 and 118, or 122 and 124) respectively as another function (e.g., a sum and a difference) of a second set of ipsilateral and contralateral cascading filters.

The processor 1104 may fetch, decode, and execute the instructions 1110 to determine, based on application of matrix decomposition to the first and second cascading filters, and the third and fourth cascading filters, a filter combination that includes a first combined filter 130 and a second combined filter 132.

The processor 1104 may fetch, decode, and execute the instructions 1112 to perform, based on application of the filter combination, audio signal processing on first and second input audio signals 136 and 138, respectively.

According to an example, the first and second cascading filters may include spatial synthesis filters, and the third and fourth cascading filters may include crosstalk cancellation filters.

According to an example, the processor 1104 may fetch, decode, and execute the instructions to determine fifth and sixth cascading filters (e.g., a remaining filter set from the filters 104 and 106, 110 and 112, 116 and 118, or 122 and 124) respectively as a further function (e.g., a sum and a difference) of a third set of ipsilateral and contralateral cascading filters. Further, the processor 1104 may fetch, decode, and execute the instructions to determine, based on the application of the matrix decomposition to the first and second cascading filters, the third and fourth cascading filters, and the fifth and sixth cascading filters, the filter combination that includes the first combined filter 130 and the second combined filter 132. Further, the processor 1104 may fetch, decode, and execute the instructions to perform, based on application of the filter combination, audio signal processing on the first and second input audio signals 136 and 138, respectively.

According to an example, the processor 1104 may fetch, decode, and execute the instructions to reduce for the first combined filter and the second combined filter, based on the application of the matrix decomposition, a total number of filters by a factor of four plus two times a number of synthesized reflections.

What has been described and illustrated herein is an example along with some of its variations. The terms, descriptions and figures used herein are set forth by way of illustration only and are not meant as limitations. Many variations are possible within the spirit and scope of the subject matter, which is intended to be defined by the following claims—and their equivalents—in which all terms are meant in their broadest reasonable sense unless otherwise indicated.

What is claimed is:

1. An apparatus comprising:

a processor; and a non-transitory computer readable medium storing machine readable instructions that when executed by the processor cause the processor to:

determine first and second spatial synthesis filters respectively as a sum and a difference of ipsilateral and contralateral spatial synthesis filters;

determine first and second crosstalk cancellation filters respectively as a sum and a difference of ipsilateral and contralateral crosstalk cancellation filters;

determine, based on application of matrix decomposition to the first and second spatial synthesis filters and the first and second crosstalk cancellation filters, a combined spatial synthesizer and crosstalk canceller that includes a first combined filter and a second combined filter; and perform, based on application of the combined spatial synthesizer and crosstalk canceller, spatial synthesis and crosstalk cancellation on first and second input audio signals.

2. The apparatus according to claim 1, wherein the instructions are further to cause the processor to:

determine first and second reflection filters respectively as a sum and a difference of ipsilateral and contralateral reflection filters;

determine, based on the application of the matrix decomposition to the first and second spatial synthesis filters, the first and second reflection filters, and the first and second crosstalk cancellation filters, the combined spatial synthesizer and crosstalk canceller that includes the first combined filter and the second combined filter; and perform, based on application of the combined spatial synthesizer and crosstalk canceller, spatial synthesis and crosstalk cancellation on the first and second input audio signals.

3. The apparatus according to claim 1, wherein the instructions are further to cause the processor to:

determine first and second reverberation filters respectively as a sum and a difference of ipsilateral and contralateral reverberation filters;

determine, based on the application of the matrix decomposition to the first and second spatial synthesis filters, the first and second reverberation filters, and the first and second crosstalk cancellation filters, the combined spatial synthesizer and crosstalk canceller that includes the first combined filter and the second combined filter; and perform, based on application of the combined spatial synthesizer and crosstalk canceller, spatial synthesis and crosstalk cancellation on the first and second input audio signals.

4. The apparatus according to claim 1, wherein the first and second spatial synthesis filters are reduced, based on the application of the matrix decomposition, from four spatial synthesis filters that include two ipsilateral spatial synthesis filters and two contralateral spatial synthesis filters to two spatial synthesis filters that include one ipsilateral spatial synthesis filter and one contralateral spatial synthesis filter.

5. The apparatus according to claim 1, wherein the first and second crosstalk cancellation filters are reduced, based on the application of the matrix decomposition, from four crosstalk cancellation filters that include two ipsilateral crosstalk cancellation filters and two contralateral crosstalk cancellation filters to two crosstalk cancellation filters that include one ipsilateral crosstalk cancellation filter and one contralateral crosstalk cancellation filter.

6. The apparatus according to claim 1, wherein the first combined filter and the second combined filter reduce, based on the application of the matrix decomposition, a total number of filters by a factor of four plus two times a number of synthesized reflections.

7. A method comprising:

determining, by a processor, first and second spatial synthesis filters respectively as a sum and a difference of ipsilateral and contralateral spatial synthesis filters;

determining first and second reflection filters respectively as a sum and a difference of ipsilateral and contralateral reflection filters;

determining first and second crosstalk cancellation filters respectively as a sum and a difference of ipsilateral and contralateral crosstalk cancellation filters;

determining, based on application of matrix decomposition to the first and second spatial synthesis filters, the first and second reflection filters, and the first and second crosstalk cancellation filters, a combined spatial synthesizer and crosstalk canceller that includes a first combined filter and a second combined filter; and performing, based on application of the combined spatial synthesizer and crosstalk canceller, spatial synthesis and crosstalk cancellation on first and second input audio signals.

8. The method according to claim 7, further comprising:

determining first and second reverberation filters respectively as a sum and a difference of ipsilateral and contralateral reverberation filters;

determining, based on the application of the matrix decomposition to the first and second spatial synthesis filters, the first and second reflection filters, the first and second reverberation filters, and the first and second crosstalk cancellation filters, the combined spatial synthesizer and crosstalk canceller that includes the first combined filter and the second combined filter; and performing, based on application of the combined spatial synthesizer and crosstalk canceller, spatial synthesis and crosstalk cancellation on the first and second input audio signals.

9. The method according to claim 7, further comprising:

reducing, based on the application of the matrix decomposition, the first and second spatial synthesis filters from four spatial synthesis filters that include two ipsilateral spatial synthesis filters and two contralateral spatial synthesis filters to two spatial synthesis filters that include one ipsilateral spatial synthesis filter and one contralateral spatial synthesis filter.

10. The method according to claim 7, further comprising:

reducing, based on the application of the matrix decomposition, the first and second crosstalk cancellation filters from four crosstalk cancellation filters that include two ipsilateral crosstalk cancellation filters and two contralateral crosstalk cancellation filters to two crosstalk cancellation filters that include one ipsilateral crosstalk cancellation filter and one contralateral crosstalk cancellation filter.

11. The method according to claim 7, further comprising:

reducing for the first combined filter and the second combined filter, based on the application of the matrix decomposition, a total number of filters by a factor of four plus two times a number of synthesized reflections.

12. A non-transitory computer readable medium having stored thereon machine readable instructions, the machine readable instructions, when executed, cause a processor to:

determine first and second cascading filters respectively as a function of a first set of ipsilateral and contralateral cascading filters;

determine third and fourth cascading filters respectively as another function of a second set of ipsilateral and contralateral cascading filters;

determine, based on application of matrix decomposition to the first and second cascading filters, and the third and fourth cascading filters, a filter combination that includes a first combined filter and a second combined filter; and perform, based on application of the filter combination, audio signal processing on first and second input audio signals.

13. The non-transitory computer readable medium according to claim 12, wherein the first and second cascading filters include spatial synthesis filters, and the third and fourth cascading filters include crosstalk cancellation filters.

14. The non-transitory computer readable medium according to claim 12, wherein the instructions are further to cause the processor to:

determine fifth and sixth cascading filters respectively as a further function of a third set of ipsilateral and contralateral cascading filters;

determine, based on the application of the matrix decomposition to the first and second cascading filters, the third and fourth cascading filters, and the fifth and sixth cascading filters, the filter combination that includes the first combined filter and the second combined filter; and perform, based on application of the filter combination, audio signal processing on the first and second input audio signals.

15. The non-transitory computer readable medium according to claim 12, wherein the instructions are further to cause the processor to:

reduce for the first combined filter and the second combined filter, based on the application of the matrix decomposition, a total number of filters by a factor of four plus two times a number of synthesized reflections.

* * * * *